US009178336B2

(12) United States Patent
Zheng et al.

(10) Patent No.: US 9,178,336 B2
(45) Date of Patent: Nov. 3, 2015

(54) SPARK PLUG

(71) Applicant: Fram Group IP, LLC, Lake Forest, IL (US)

(72) Inventors: Jing Zheng, Findlay, OH (US); Jeffrey T. Boehler, Holland, OH (US)

(73) Assignee: Fram Group IP, LLC, Lake Forest, IL (US)

( * ) Notice: Subject to any disclaimer, the term of this patent is extended or adjusted under 35 U.S.C. 154(b) by 0 days.

(21) Appl. No.: 14/157,251

(22) Filed: Jan. 16, 2014

(65) Prior Publication Data

US 2014/0134912 A1 May 15, 2014

Related U.S. Application Data

(62) Division of application No. 13/444,098, filed on Apr. 11, 2012, now Pat. No. 8,963,406.

(60) Provisional application No. 61/492,868, filed on Jun. 3, 2011.

(51) Int. Cl.
*H01T 21/02* (2006.01)
*H01T 13/41* (2006.01)

(52) U.S. Cl.
CPC ..... *H01T 21/02* (2013.01); *H01T 13/41* (2013.01)

(58) Field of Classification Search
CPC ..... H01T 13/41
USPC ..... 313/141
See application file for complete search history.

(56) References Cited

U.S. PATENT DOCUMENTS

| | | | | |
|---|---|---|---|---|
| 3,909,459 | A * | 9/1975 | Friese et al. | 252/509 |
| 4,446,058 | A | 5/1984 | Sakai et al. | |
| 4,482,475 | A | 11/1984 | Sakai et al. | |
| 6,137,211 | A | 10/2000 | Sugimoto et al. | |
| 6,583,537 | B1 * | 6/2003 | Honda et al. | 313/136 |
| 6,590,318 | B2 | 7/2003 | Nishikawa et al. | |
| 8,455,381 | B2 * | 6/2013 | Sugimoto et al. | 501/139 |
| 2001/0004184 | A1 | 6/2001 | Ito et al. | |
| 2001/0007196 | A1 | 7/2001 | Sugimoto et al. | |
| 2004/0043885 | A1 * | 3/2004 | Hormadaly | 501/32 |
| 2010/0048083 | A1 * | 2/2010 | Shibata et al. | 445/7 |

FOREIGN PATENT DOCUMENTS

JP 2009-245716 10/2009

OTHER PUBLICATIONS

WO 2011/036871 to Yoshida and a machine translation of this document. Pub. Mar. 31, 2011.*
Final Office Action from U.S. Appl. No. 13/444,098, dated Jun. 24, 2014.
International Search Report, PCT/US2012/033177, Oct. 19, 2012, 9 pages.

* cited by examiner

*Primary Examiner* — Karabi Guharay
*Assistant Examiner* — Zachary J Snyder
(74) *Attorney, Agent, or Firm* — Mark J. Nahnsen; Barnes & Thornburg LLP

(57) ABSTRACT

A spark plug is provided having a resistor. The resistor is made from resistor glass material containing an alkali free barium alumino-silicate glass mixed with mullite. In one embodiment, the resistor is a 15 to 30 wt % alkali free barium alumino-silicate glass and 10 to 25 wt % mullite. The resistor material provides for a greater processing kiln temperature range with reduced resistor variability and improved durability performance.

19 Claims, 4 Drawing Sheets

SPARK PLUG

BACKGROUND OF THE INVENTION

This application is a divisional of co-pending U.S. patent application Ser. No. 13/444,098 filed Apr. 11, 2012, the disclosure of which is incorporated herein by reference in its entirety.

The subject matter disclosed herein relates to a spark plug and in particular to a spark plug having a resistor made with glass materials with an increased glass transition temperature.

Spark plugs are widely used to ignite fuel in internal combustion engines. Spark plugs are subject to intense heat in a highly corrosive environment of a vehicle engine. As a result, a spark plug having high durability and useful life is desireable. Further, in addition to igniting fuel, in some applications the spark plug is influencing the senor signal acquired by the vehicle control system to monitor the operation of the engine. These applications typically require tighter electrical tolerances and lower electromagnetic interference (EMI) to reduce interference with signals from both the spark plug itself and the surrounding control circuitry.

Accordingly, while existing spark plugs are suitable for their intended purposes, there remains a need for improvements particularly in providing a spark plug with tighter resister tolerance.

BRIEF DESCRIPTION OF THE INVENTION

According to one aspect of the invention, a spark plug is provided having a resistor made from a mixture of alkali free barium alumino-silicate glass and mullite.

According to another aspect of the invention, a spark plug is provided having an insulator having an inner bore. A center electrode extends from one end of the inner bore. An insert extends from an opposite side of the inner bore. A resistor is disposed between the center electrode and the insert, the resistor being made from a mixture of alkali free barium alumino-silicate glass and mullite.

According to yet another aspect of the invention, a method of fabricating a sparkplug is provided. The method includes mixing carbon and ceramic powder to make carbon slurry. The carbon slurry is added to a glass mixture containing an alkali free barium borate glass and Mullite. The carbon slurry-glass mixture is dried and then screened to form a carbon resistor glass. The carbon resistor glass is loaded into a sparkplug insulator. The sparkplug insulator-carbon glass assembly is heated to transform the carbon resistor glass into a semi-melt condition.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Embodiments of the present invention provide advantages in reducing the variation of resistance values for a resistor in a spark plug application. It has been found that the resistor glass materials are sensitive to kiln process temperature. This temperature sensitivity leads to a variation in resistance during the spark plug assembly process. Embodiments of the present invention provide for a resistor material that has an improved durability, a longer useful life and may be processed at a wider range of processing temperatures while maintaining a low variation in resistance. Embodiments of the present invention further provide for a smaller electromagnetic interference range for spark plugs.

Figure 1:
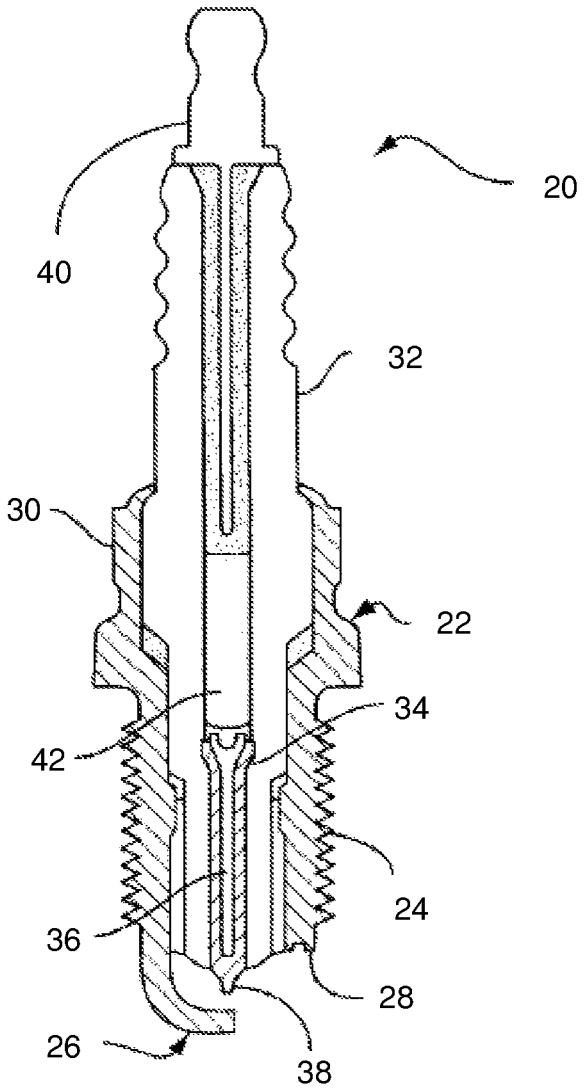
FIG. 1 is a side sectional view of a spark plug in accordance with an embodiment of the invention.

Referring to FIG. 1, a spark plug 20 is shown in accordance with the present invention. The spark plug 20 includes a metal casing or shell 22 having an externally threaded cylindrical base 24 for threadable engagement in the cylinder head of an internal combustion engine (not shown). The shell may include a generally hexagonal boss 30 thereon to allow for grasping and turning of the spark plug 20 with a suitable tool, such as a conventional spark plug socket for example. A bi-metallic ground electrode 26 is coupled, such as by welding for example, to a lower surface 28 of the threaded base 24.

The spark plug 20 further includes a ceramic insulator 32 disposed concentrically within the shell 22. A center electrode 34 is disposed concentrically within the insulator 32. The center electrode 34 may include a central core 36 made from a thermally conductive material, such as copper or a copper alloy for example. An electrode tip 38 is disposed on one end of the center electrode 34. Opposite the electrode tip 38 is an electrically conductive insert or rod 40. The insert 40 fits into the upper end of the insulator 32 and forms Disposed between the insert 38 and the center electrode 32 is an internal resistor 42. As will be discussed in more detail herein, the resistor material and assembly process influence resistance value of the internal resistor 42, the durability, useful life and EMI emissions of the spark plug 20. In the exemplary embodiment, the resistor 42 is formed from a mixture of an alkali free barium alumino-silicate glass, Mullite, carbon, ceramic powders and other ingredients. The glass is composed of MgO 2.0 wt %-Al2O3 11.3 wt %-SiO2 53.5 wt %-CaO-12.0 wt %-BaO-20.5 wt % in composition. In one embodiment, the mixture has 15-30 wt % glass and 10-25% Mullite and the balance is ceramic powder, carbon, borate glass and organic binders.

To form resistor glass containing the alkali free barium alumino-silicate glass, first all the components, glasses, Mullite and other materials, are weighed and a carbon slurry, containing carbon and ceramic powders (ZrO2) is added. The components are mixed for a predetermined amount of time. In the exemplary embodiment the components are mixed for seven minutes. Ice is added to components and further mixed for a predetermined amount of time, such as 10 minutes for example. After the components and ice are mixed, the mixture is oven dried. In the exemplary embodiment, the mixture is oven dried for 5 hours at 120 C. Following the drying, the mixture is screened, such as with a #20 mesh for example. The material processed through the screen is ready to be used for assembling resistor for sparkplugs.

To assemble the resistor for sparkplug, the above finished powders are loaded in the sparkplug insulator with centerwire and stud terminal. The whole assembly was then processed through a high temperature kiln with peak temperature between 1700 F to 1800 F.

Figure 2:
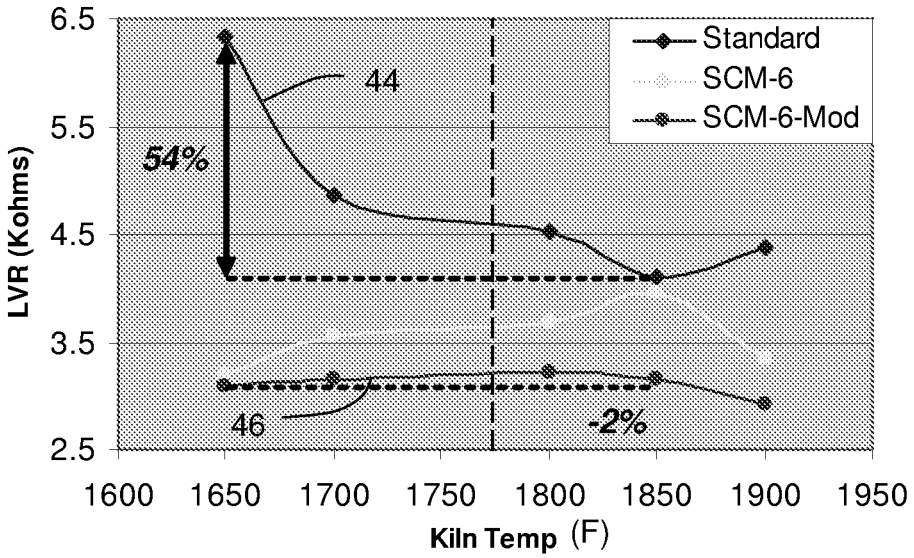
FIG. 2 is a graph showing the results of a spark plug resistance test based on controlled kiln temperature.

FIG. 2 shows the low voltage resistance of the resistor 42 at different kiln processing temperatures. The standard glass formulation indicated by line 44 shows a substantial variation in resistance of 54% over a processing temperature range of 200 degrees. In contrast, the exemplary alkali free barium alumino-silicate glass/mullite resistor 42, indicated by line 46, had only a 2% variation over the same temperature range. It should be appreciated that this reduction in variation in resistance results in larger production yields. Current production processes have a target kiln temperature of 1775° F. and the temperature is controlled within±50° F. in order to achieve a desired resistance value from the resistor 42.

Figure 3:
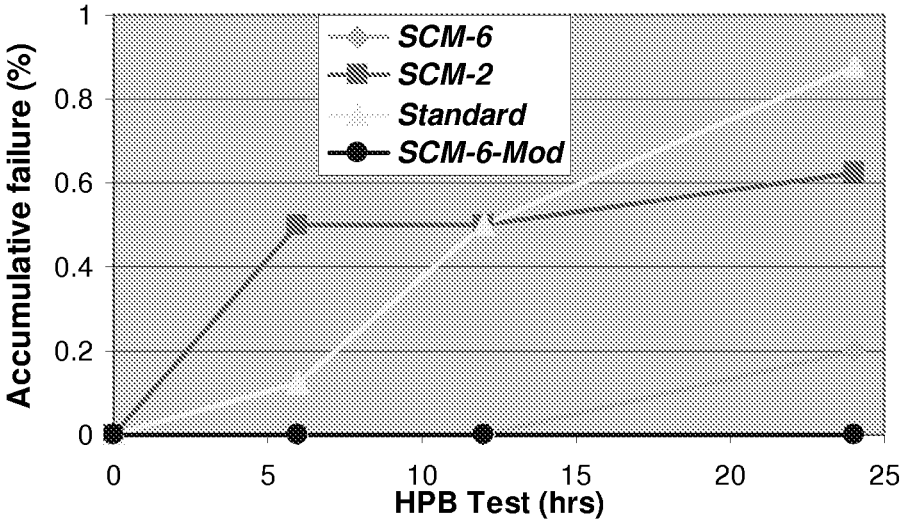
FIG. 3 is a graph showing the results of a spark plug accumulated failure rate under accelerated testing.

FIG. 3 shows a life curves from accelerated life tests for the exemplary alkali free barium alumino-silicate glass/mullite resistor 42 and standard spark plug resistors (as a comparison) when processed at elevated temperature of 1900 F. The accelerated life tests were conducted in a heated pressure bomb at engine cylinder pressure. The standard spark plug resistor had initial failures being at six hours. The exemplary akili free barium alumino-silicate glass/mullite resistor 42 in contrast had no failures over a twenty-four hour period. The results suggest that the resistor materials containing alkali free barium alumino-slicate glass and Mullite has a wider process window to yield products with improved performance and/or longer useful life.

Figure 4:
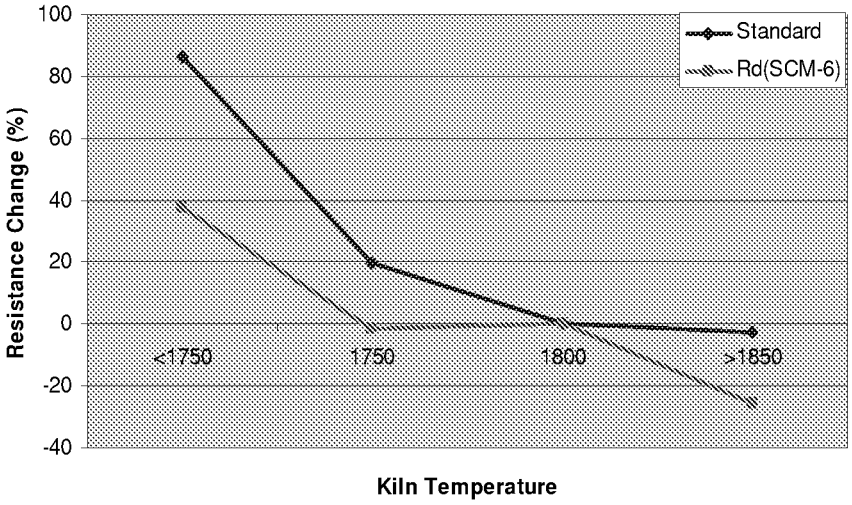
FIG. 4 is a graph showing the results of a spark plug resistance change based on production kiln temperature; and, FIG. 5 is a flow chart showing a method of fabricating a spark plug in accordance with an embodiment of the invention.

FIG. 4 shows a resistance change curve for another embodiment alkali free barium alumino-silicate glass/mullite resistor 42 and a standard spark plug resistor (as a comparison), processed on standard production kiln. The alkali free barium alumino-silicate glass/mullite resistor 42 shows a lower resistor variation in temperature ranges lower than 1800° F., and has a processing window with a substantially flat resistance between 1750° F. to 1800° F.

Figure 5:
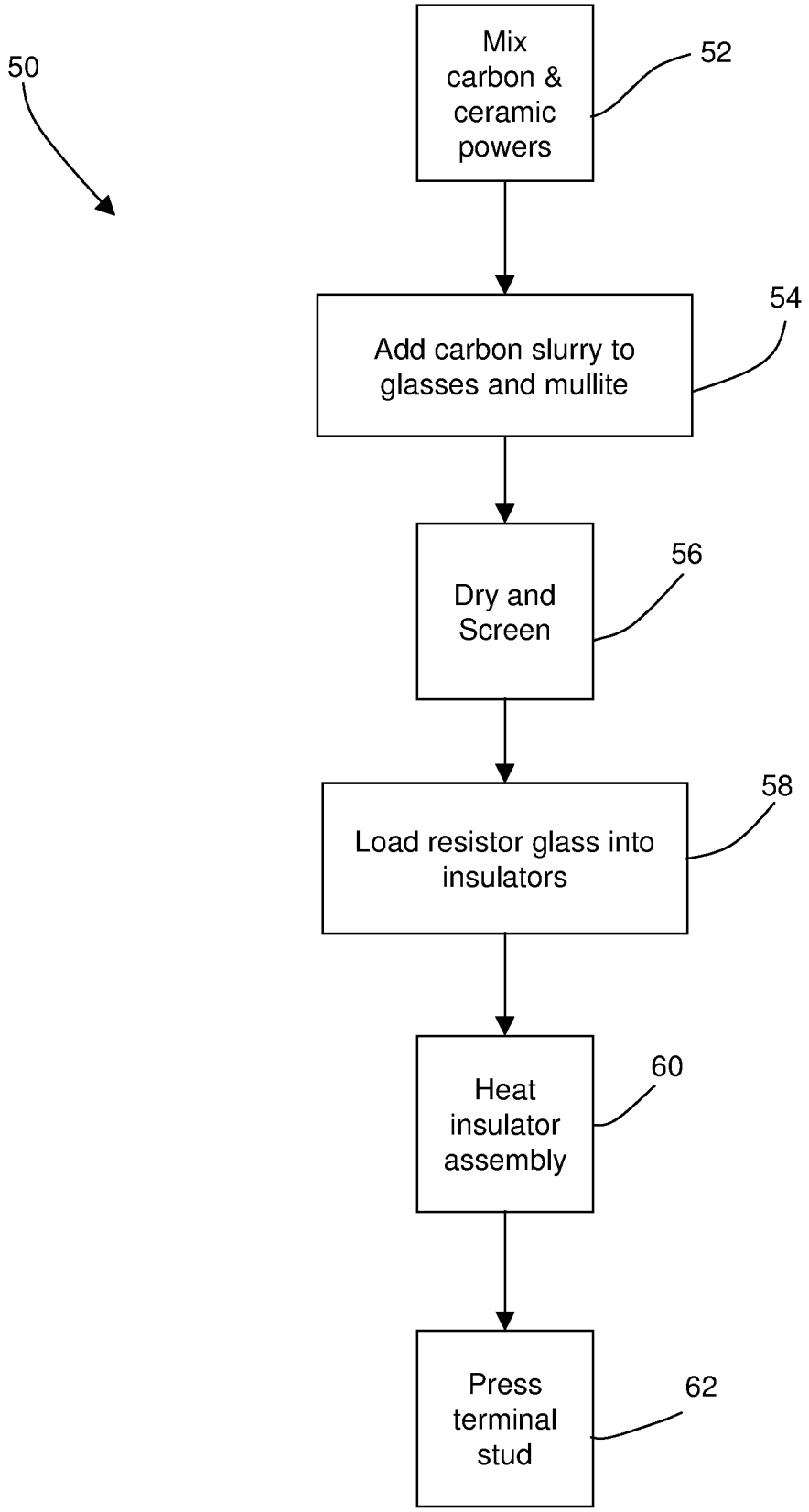

Referring now to FIG. 5, a method 50 of fabricating a spark plug, such as spark plug 20 for example is shown. The method 50 starts in block 52 where carbon and ceramic powder are mixed to make carbon slurry. The carbon slurry is added to the glass mixture and Mullite in block 54. The glass mixture includes but is not limited to alkali free barium borate glass. The alkali free barium borate glass may be composed of MgO 2.0 wt %-Al2O3 11.3 wt %-SiO2 53.5 wt %-CaO-12.0 wt %-BaO-20.5 wt % in composition. In one embodiment, the mixture has 15-30 wt % glass and 10-25% Mullite and the balance is ceramic powder, carbon, borate glass and organic binders. The mixture is then dried and screened in block 56 to form a carbon resistor glass.

The desired volume of carbon resistor glass is then loaded into sparkplug insulators, such as insulator 32 for example, in block 58. The above insulator glass assembly is then subject to high temperature environment in block 60. In one embodiment, the insulator-glass assembly is carried on a conveyor through an oven operating at a temperature of 1650 F to 1850 F. At the end of the firing cycle, a plunge (terminal stud), such as insert 40 for example, is pressed into the insulator in block 62 so that the glass powders (in semi-melt condition) can be compacted into dense condition and the resistor is hence formed and sealed into the sparkplugs.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of fabricating a sparkplug comprising:

mixing carbon and ceramic powder to make a carbon slurry;

adding the carbon slurry to a glass mixture, wherein the carbon slurry-glass mixture comprises from 15 to 30% by weight of an alkali free barium alumino-silicate glass, from 10 to 25% by weight Mullite, and the balance being comprised of the ceramic powder, carbon, borate glass, and organic binders;

drying the carbon slurry-glass mixture;

forming a carbon resistor glass;

loading the carbon resistor glass into a sparkplug insulator to form an insulator-carbon resistor glass assembly; and heating the insulator-carbon resistor glass assembly to transform the carbon resistor glass into a semi-melt condition.

2. The method of claim 1 further comprising screening the carbon slurry-glass mixture after drying.

3. The method of claim 2 wherein the screening is performed with a #20 mesh.

4. The method of claim 1 further comprising mixing the carbon slurry-glass mixture containing the alkali free barium alumino-silicate glass, the Mullite and the carbon slurry for a first predetermined amount of time.

5. The method of claim 4 wherein the first predetermined amount of time is seven minutes.

6. The method of claim 4 further comprising mixing ice with the carbon slurry-glass mixture containing the alkali free barium alumino-silicate glass, the Mullite and the carbon slurry for a second predetermined amount of time.

7. The method of claim 6 wherein the second predetermined amount of time is ten minutes.

8. The method of claim 1 further comprising pressing a terminal stud into said insulator-carbon resistor glass assembly when the carbon resistor glass is in a semi-melt condition.

9. The method of claim 8 wherein the alkali free barium alumino-silicate glass is comprised of MgO 2.0 wt %-$Al_2O_3$ 11.3 wt %-$SiO_2$ 53.5 wt %-CaO-12.0 wt %-BaO-20.5 wt % in composition.

10. The method of claim 9 wherein the heating of the insulator-carbon resistor glass assembly is performed in a kiln at a processing temperature between 1650° F. and 1850° F.

11. A method of fabricating a sparkplug comprising:

mixing carbon and ceramic powder to make carbon slurry;

adding the carbon slurry to a glass mixture, wherein the carbon slurry-glass mixture comprises from 15 to 30% by weight of an alkali free barium alumino-silicate glass and from 10 to 25% by weight Mullite;

drying the carbon slurry-glass mixture;

screening the carbon slurry-glass mixture after drying with a #20 mesh;

forming a carbon resistor glass;

loading the carbon resistor glass into a sparkplug insulator to form an insulator-carbon resistor glass assembly; and heating the insulator-carbon resistor glass assembly to transform the carbon resistor glass into a semi-melt condition.

12. The method of claim 11 further comprising mixing the glass mixture containing an alkali free barium alumino-silicate glass, Mullite and carbon slurry for a first predetermined amount of time.

13. The method of claim 12 wherein the first predetermined amount of time is seven minutes.

14. The method of claim 12 further comprising mixing ice with the glass mixture containing an alkali free barium alumino-silicate glass, Mullite and carbon slurry for a second predetermined amount of time.

15. The method of claim 14 wherein the second predetermined amount of time is ten minutes.

16. The method of claim 11 further comprising pressing a terminal stud into said insulator-carbon resistor glass assembly when the carbon resistor glass is in a semi-melt condition.

17. The method of claim 11 wherein the heating of the insulator-carbon resistor glass assembly is performed in a kiln at a processing temperature between 1650° F. and 1850° F.

18. The method of claim 11 wherein the alkali free barium alumino-silicate glass is comprised of MgO 2.0 wt %-$Al_2O_3$ 11.3 wt %-$SiO_2$ 53.5 wt %-CaO-12.0 wt %-BaO-20.5 wt % in composition.

19. A method of fabricating a sparkplug comprising:

mixing carbon and ceramic powder to make a carbon slurry;

adding the carbon slurry to a glass mixture, wherein the carbon slurry-glass mixture comprises an alkali free barium alumino-silicate glass;

drying the carbon slurry-glass mixture;

forming a carbon resistor glass;

loading the carbon resistor glass into a sparkplug insulator to form an insulator-carbon resistor glass assembly; and heating the insulator-carbon resistor glass assembly to transform the carbon resistor glass into a semi-melt condition;

wherein the alkali free barium alumino-silicate glass is comprised of MgO 2.0 wt %-$Al_2O_3$ 11.3 wt %-$SiO_2$ 53.5 wt %-CaO-12.0 wt %-BaO-20.5 wt % in composition.

* * * * *